United States Patent [19]

Mizusawa

[11] 4,124,091

[45] Nov. 7, 1978

[54] SILENCER FOR AN INTERNAL COMBUSTION ENGINE

[75] Inventor: Shinichiro Mizusawa, Okazaki, Japan

[73] Assignee: Toyota Jidosha Kogyo Kabushiki Kaisha, Toyota, Japan

[21] Appl. No.: 825,689

[22] Filed: Aug. 18, 1977

Related U.S. Application Data

[63] Continuation-in-part of Ser. No. 693,854, Jun. 8, 1976, abandoned.

[30] Foreign Application Priority Data

Dec. 24, 1975 [JP] Japan ..... 50-155644

[51] Int. Cl.[2] ..... F01N 1/08

[52] U.S. Cl. ..... 181/231; 181/258; 181/269; 181/273

[58] Field of Search ..... 181/258, 269, 273, 212, 181/211, 264, 256, 265, 281, 231

[56] References Cited

U.S. PATENT DOCUMENTS

| | | | |
|---|---|---|---|
| 2,392,559 | 1/1946 | Varma | 181/258 |
| 3,519,098 | 7/1970 | Plaga, Jr. | 181/269 |
| 3,677,364 | 7/1972 | Pawlina | 181/269 |
| 3,887,032 | 6/1975 | Harris | 181/273 |
| 3,960,239 | 6/1976 | Frochaux et al. | 181/258 |

*Primary Examiner*—Robert C. Watson

[57] ABSTRACT

A silencer which may be arranged in place in an exhaust system of an internal combustion engine includes walls forming the main body of the silencer; a first separator supported by the walls to define a rear chamber therebetween; a second separator supported by the walls to define a first intermediate chamber between the walls and the first and second separators; a flame-extinguishing device supported by the walls to define a second intermediate chamber in combination with the walls, the second separator and the flame-extinguishing device as well as to define a front chamber between the walls and the flame-extinguishing device; an inlet pipe in fluid communication with the front chamber whereby an exhaust gas may flow from the inlet pipe into the front chamber; an outlet pipe in fluid communication with the first intermediate chamber whereby the exhaust gas may flow out of the first intermediate chamber through the outlet pipe; and an inner pipe having a plurality of apertures formed therein.

9 Claims, 6 Drawing Figures

SILENCER FOR AN INTERNAL COMBUSTION ENGINE

This application is a continuation-in-part application of co-pending application Ser. No. 693,854, filed June 8, 1976 and now abandoned.

BACKGROUND OF THE INVENTION

The present invention relates to an improved silencer for an internal combustion engine:

In driving a vehicle having an internal combustion engine the engine is susceptible to an accidental fire immediately after a traversing a long slope, an abrupt or sudden speed reduction, racing or a gear change. In such a state, afterburning can possibly take place in the exhaust system in some instances. In addition, a small quantity of a raw fuel may be sucked into the engine due to the continuation of the motion of the engine by inertia and may then be discharged into the exhaust system in the form of an unburned fuel, even after switching off the engine for stopping the operation of the engine. The raw fuel discharged into the exhaust system as an unburned fuel is subjected to burning in the exhaust system specially a raw fuel that stagnates in the main muffler. The raw fuel may then be subjected to explosive combustion, which causes the pressure to rise, until the raw fuel is discharged from the exhaust system at acoustic velocity. This condition has thus far constituted a serious defect not only on the respective sections of the vehicle having an internal combustion engine mounted thereon but also on the environment outside of the vehicle, as well as on the exhaust system. In other words, a tremendously harsh noise or explosion is often generated thereby, and even a flame may be blown out from the tail pipe at the outlet of the exhaust system. Obviously, such an occurrence would constitute a serious hazard.

Available thus far as methods for preventing such afterburning as set forth above have been:

(1) a method for causing an unburned, mixed gas that is discharged from an engine to be subjected to burning while the gas still remains in an upstream portion thereof in a sound absorbing apparatus;

(2) either an exhaust manifold or a thermal reactor is suitably subjected to cooling, thus preventing an unburned, mixed gas from being subjected to spontaneous ignition; and (3) a flame and the sound of explosion that results at the time of an explosion in the middle of the exhaust system of a silencer are caused to be extinguished and absorbed at the outlet of the exhaust system by means of a flame-extinguishing device.

In the third one of the above-mentioned methods, one form of prior art that is presently available provides either a wire mesh, a filter, or the like positioned, at the outlet of an exhaust pipe. However, the method of this category is not designed for flame extinguishment, since the flame extinguishment structure is specifically intended for the purpose of preventing red-hot sparks of carbon from being scattered around. To meet the proposed requirement, the meshes of a wire net need be sufficiently reduced in size, which often results in clogging. Furthermore, in such a case wherein an unburned mixed gas should be subjected to explosion within a sound absorbing apparatus, a tremendously powerful flame is injected, which has thus far made it quite difficult, if not impracticable, to effect prevention of afterburning.

To cope with such a situation, introduced so far by the prior art has been a type of afterburning preventive device as is specifically intened for the purpose of overcoming the conventionally encountered difficulty mentioned above by preventing an explosion of an unburned mixed gas generated at the time of speed reduction or shut-off of an engine. A flame-extinguishing device provided with a perforated and narrow exhaust gas flow channel is positioned in a silencer that is arranged in the exhaust system of an internal combustion engine. Heat is caused to be absorbed from a flame while the flame passes through the flame-extinguishing device, whereby the flame is subjected to extinguishment. The unburned, mixed gas passing through a flow channel arranged at a position downstream of the flame-extinguishing device is thereby prevented from being subjected to inflammation. The pressure of the unburned mixed gas is prevented from rising to a level that corresponds to the acoustic velocity.

However, for the purpose of achieving greater flame-extinguishing effect and providing favorable simplification in the construction of a flame-extinguishing device, it is imperative to develope such a method wherein an effective flame-extinguishing area can be utilized to the maximum extent possible, and to eliminate several difficulties involved in the manufacture thereof, as well as to work out a new design for the construction of the flame-extinguishing device, including an interstice, that is positioned so as to compensate for irregularities resulting from thermal fluctuations in dimensions attributable to the temperature difference in the positions of the constituent components thereof, and that a flame can be prevented in an effective manner for passing through the same.

SUMMARY OF THE INVENTION

It is an object of the present invention to provide a silencer having an afterburning preventive effect which features at the time of assembling a flame-extinguishing device in place in the silencer, an inlet pipe, an inner pipe and an outlet pipe that are so designed as not to pass through a flame-extinguishing device, whereby the mode of coupling the constituent components is simplified.

According to the present invention, there is provided a silencer which may be arranged in place in an exhaust system of an internal combustion engine, a flame-extinguishing device being provided in place in said silencer, characterized by a rear chamber, a first intermediate chamber and a second intermediate chamber being defined by and among the flame-extinguishing device a first separator and a second separator, by which separators an inner pipe is supported to connect said second intermediate chamber with said rear chamber.

DETAILED DESCRIPTION OF THE INVENTION

Figure 1:
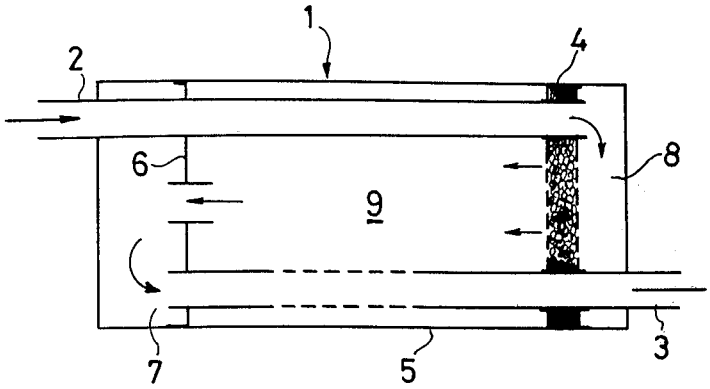
FIG. 1 is a schematic side elevation view of a silencer of a conventional type having an after-burning preventive effect.

A preferred embodiment of the present invention will be described in detail, as compared with prior art, by making reference to the drawing.

FIG. 1 shows a silencer 1 of a conventional type. A front chamber 7 and a rear chamber 8 are sectioned and formed by a separator 6 through which extend an inlet pipe 2 and an outlet pipe 3, respectively, a flame-extinguishing device 4 and the walls of the main body 5 of the silencer 1. An exhaust gas is caused to flow to the outside of the silencer 1 by way of the passage bearing the reference characters 2-8-4-9-7-3 in that sequence.

At the time of operating the engine, the constituent components thereof respectively have different levels of temperature from one another. It is imperative in the prior art construction that an appropriately sized gap be formed between adjoining constituent components for the purpose of compensating for irregularities that are attributable to differences in the respective thermal expansion coefficients thereof. The gap should be so limited as to be of a designated dimension (for instance, less than 0.5mm) for the purpose of preventing a flame from passing through the gap. Furthermore, it is also imperative in the prior art that any component that passes through another component be so designed as to be capable of sliding. These facts result in requiring a large quantity of labor for effecting proper control of dimensions, thus constituting an obstacle to efficient productivity.

Figure 2:
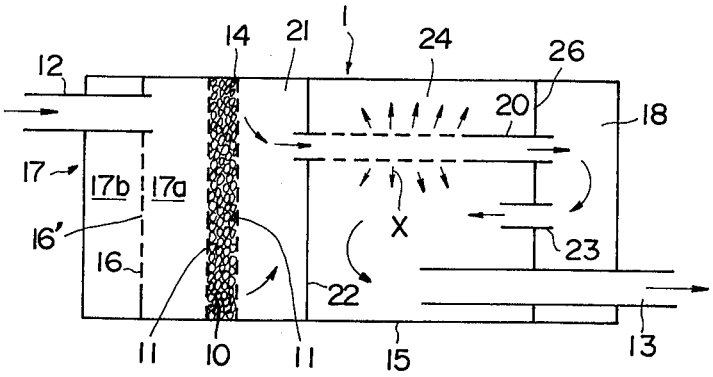
FIG. 2 is a schematic side elevational view of a silencer according to an embodiment of the present invention.
Figure 3:
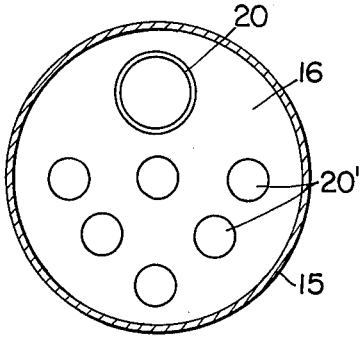
FIG. 3 is a transverse sectional elevational view of the embodiments shown in FIG. 2.
Figure 5:
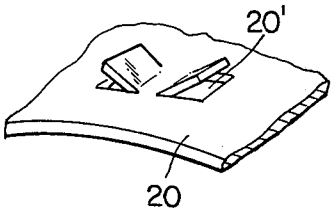
FIG. 5 is an enlarged perspective view illustrating a portion of FIG. 4.
Figure 4:
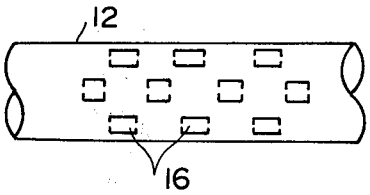
FIG. 4 is a fragmentary side elevational view of one of the components shown in FIG. 2.
Figure 6:
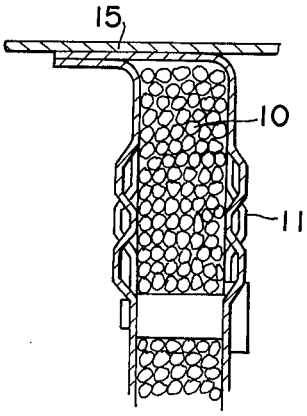
FIG. 6 is an enlarged sectional side elevational view fragmentarily showing a portion of the structure of FIG. 2.

FIG. 2 shows an embodiment of the present invention whereby none of the components extend through the flame-extinguishing device 14. In FIG. 2, the main body 1 of the silencer is formed by walls 15. The flame-extinguishing device 14 is supported by the walls 15. A front chamber 17 is defined by and is located between the walls 15 and the flame-extinguishing device 14. A rear chamber 18 is defined by and is located between the walls 15 and a first separator 26 which is supported by the walls 15. A first intermediate chamber 24 is defined by the walls 15, the first separator 26 and a second separator 22. A second intermediate chamber 21 is defined by the walls 15, the second separator 22 and the flame-extinguishing device 14. The front chamber 17 is divided into two sections 17*a* and 17*b* by means of a third separator 16 which has a plurality of apertures 16′ formed therein, for example by drilling. The first section 17*a* of the front chamber 17 is in fluid communication through the apertures 16′ with the second section 17*b* thereof. An inlet pipe 12 is in fluid communication with the first section 17*a* of the front chamber 17. An inner pipe 20 is supported by the first and second separators 26 and 22 to fluidly couple the second intermediate chamber 21 with the rear chamber 18. The inner pipe 20 has a plurality of apertures therein through which a limited quantity of the exhaust gas may leak into the first intermediate chamber 24 in the directions shown by the arrows X. A connecting pipe 23 is supported by the first separator 26 to fluidly couple the rear chamber 18 with the first intermediate chamber 24. An outlet pipe 13 is provided to fluidly couple the first intermediate chamber 24 with any appropriate place (not shown).

The flame-extinguishing device 14 has a space formed therein by a pair of porous plates 11 and the inner walls 15 of the main body 1, and is filled with a non-catalytic material which may be in the form of a plurality of globules 10 having a diameter of from 2mm to 7mm, made from an aluminum oxide, steel, glass and other materials. It is desirable to provide at least three layers of such globules 10 in the direction of flow to form a maze for the flame passing through.

In operation, the exhaust gas flows into the front chamber 17 from the inlet pipe 12, has the flame thereof extinguished at the time of passing through the flame-extinguishing device 14 that is downstream of the front chamber 17, flows into the inner pipe 20, flows into the rear chamber 18, and flows out from the outlet pipe 13 by way of the connecting pipe 23 and the intermediate chamber 24.

In the construction according to the present invention, the flame-extinguishing device 14 does not have any pipe extending therethrough and the whole area of the silencer can be utilized in an effective manner so that the flame-extinguishing capacity is improved. A consideration in terms of the construction as is required to be exercized regarding the space between coupled components in case a through-component is present can be cast aside, thus serving to simplify the design and the manufacturing means as well, which constitutes a secondary characteristic of this construction. Instead, the exhaust that is to be subjected to flame extinguishment by the flame-extinguishing device becomes an object only of noise-elimination in the subsequent downstream area, and then is discharged from the outlet pipe 13, after being subjected to noise-elimination in an effective manner, by virtue of partial leakage and a diffusing function along the perforated passage.

The separators 16, 22 and 26 section and form the respective chambers 17, 18, 21 and 24 in conjunction with the flame-extinguishing device 14 and the walls 15 of the main body, and bear the load required for fitting the respective pipes in place. Furthermore, the separator 16 for the front chamber 17 has a plurality of apertures 16′ formed therein by drilling, whereby the front chamber 17 can be utilized as a resonance chamber, thus causing a beneficial effect of noise-elimination to be achieved.

The present invention is constructed as set forth in the preceding paragraphs. Therefore, the flame-extinguishing function can be considerably enhanced by making effective use of the entire flame-extinguishing area of the flame-extinguishing device up to the maximum possible level. Productivity can be increased a great deal by the simplification of the construction of the components of the sound absorbing apparatus, which can be materialized in such a manner as is set forth in the preceding paragraphs and, in addition thereto, a favorable effect of improving the sound absorbing function can be achieved by utilizing the resonance eliminating performance of the front chamber.

I claim:

1. A silencer which may be positioned in an exhaust system of an internal combustion engine, said silencer comprising:

walls forming the main body of said silencer;

a first separator supported by said walls, to thereby define a rear chamber therebetween;

a second separator supported by said walls, to thereby define a first intermediate chamber between said walls and said first and second separators;

a flame-extinguishing device having a space formed therein by a pair of porous plates and said walls of the main body and being filled with a non-catalytic material to thereby define a second intermediate chamber between said walls and said second separator as well as to define a front chamber between said walls and said flame-extinguishing device;

an inlet pipe in fluid communication with said front chamber whereby an exhaust gas may flow from said inlet pipe into said front chamber and over the entire surface of said flame extinguishing device;

an outlet pipe in fluid communication with said first intermediate chamber whereby the exhaust gas may flow out of said first intermediate chamber through said outlet pipe; and an inner pipe positioned between said first and said second separators to fluidly couple said second intermediate chamber with said rear chamber, said inner pipe having a plurality of apertures formed therein through which the exhaust gas may lead into said first intermediate chamber, said inlet and outlet pipes and said inner pipe being positioned such that they do not extend through said flame extinguishing device whereby the active surface area and therefor the capacity of said flame extinguishing device are increased.

2. The silencer as defined in claim 1, further comprising a connecting pipe supported by said first separator to fluidly couple said rear chamber to said first intermediate chamber whereby the exhaust gas may flow from said inlet pipe through said front chamber, said flame-extinguishing device, said second intermediate chamber, said inner pipe, said rear chamber, said connecting pipe and said first intermediate chamber into said outlet pipe.

3. The silencer as defined in claim 1, further comprising a third separator made of a perforated plate and supported by said walls, to thereby divide said front chamber into two sections.

4. The silencer as defined in claim 3, further comprising a connecting pipe supported by said first separator for fluidly coupling said first intermediate chamber to said rear chamber whereby the exhaust gas may flow from said inlet pipe through said third separator, said flame-extinguishing deviee, said second intermediate chamber, said inner pipe, said rear chamber, said connecting pipe and said first intermediate chamber into said outlet pipe.

5. The silencer as defined in claim 3, wherein said inlet pipe is in fluid communication with one of said sections which faces said flame-extinguishing device.

6. The silencer as defined in claim 5 further comprising a connecting pipe supported by said first separator for fluidly coupling said first intermediate chamber to said rear chamber whereby the exhaust gas may flow from said inlet pipe through said flame-extinguishing device, said second intermediate chamber, said inner pipe, said rear chamber, said connecting pipe and said first intermediate chamber into said outlet pipe.

7. The silencer as defined in claim 1, wherein said non-catalytic material is comprised of a plurality of globules.

8. The silencer as defined in claim 7 wherein said globules have a diameter ranging in size from 2mm to 7 mm.

9. The silencer as defined in claim 7 wherein said globules are arranged in at least three layers in the direction of flow of the exhaust gas.

* * * * *